US008657320B2

(12) United States Patent
Alber

(10) Patent No.: US 8,657,320 B2
(45) Date of Patent: Feb. 25, 2014

(54) SENSOR ARRANGEMENT

(75) Inventor: Markus Alber, Albstadt (DE)

(73) Assignee: AAT Alber Antriebstechnik GmbH, Albstadt (DE)

( * ) Notice: Subject to any disclaimer, the term of this patent is extended or adjusted under 35 U.S.C. 154(b) by 79 days.

(21) Appl. No.: 13/483,511

(22) Filed: May 30, 2012

(65) Prior Publication Data

US 2012/0326414 A1 Dec. 27, 2012

(30) Foreign Application Priority Data

Jun. 25, 2011 (DE) ..... 10 2011 105 570

(51) Int. Cl.
*A61G 5/04* (2013.01)

(52) U.S. Cl.
USPC ..... 280/250.1; 180/907

(58) Field of Classification Search
USPC ..... 280/250.1; 180/907
See application file for complete search history.

(56) References Cited

U.S. PATENT DOCUMENTS 4,050,533 A * 9/1977 Seamone ..... 180/6.5
6,230,831 B1 5/2001 Ogata et al.

FOREIGN PATENT DOCUMENTS

| | | | |
|---|---|---|---|
| DE | 198 48 530 | 2/2000 | |
| DE | 19848530 C1 * | 2/2000 | ..... A61G 5/04 |
| DE | 698 33 753 | 8/2006 | |
| DE | 20 2008 017 258 | 4/2009 | |
| DE | 20 2009 009 929 | 11/2009 | |
| EP | 0 832 632 | 3/2003 | |

* cited by examiner

*Primary Examiner* — Kevin Hurley
*Assistant Examiner* — Michael Stabley
(74) *Attorney, Agent, or Firm* — Michael J. Striker

(57) ABSTRACT

A sensor arrangement for a wheelchair wheel that has a running wheel with a hub and a hand rim includes a running wheel fastening arrangement that is fastened to the running wheel, a hand rim fastening arrangement that is fastened to the hand rim and at least one sensor that detects a movement of the hand rim fastening arrangement relative to the running wheel fastening arrangement. Two restoring elements are provided on the running wheel fastening arrangement and rest against the hand rim arrangement with a prestressing force at least in the zero position. Both restoring elements rest against at least one stop of the running wheel fastening arrangement in the zero position of the sensor arrangement.

16 Claims, 5 Drawing Sheets

SENSOR ARRANGEMENT

CROSS-REFERENCE TO A RELATED APPLICATION

Figure 1A:
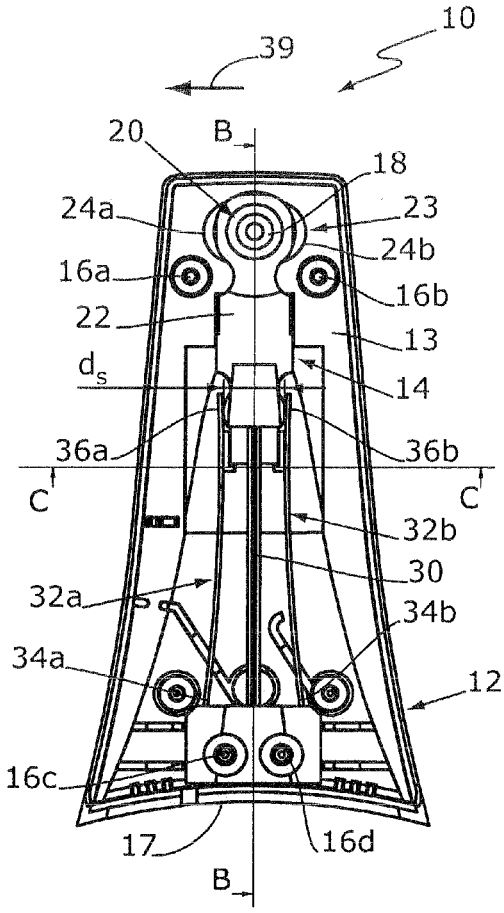

The invention described and claimed hereinbelow is also described in German Patent Application DE 10 2011 105570.7, filed on Jun. 25, 2011. The German Patent Application, whose subject matter is incorporated by reference herein, provides the basis for a claim of priority of invention under 35 U.S.C. 119(a)-(d).

BACKGROUND OF THE INVENTION

The invention relates to a sensor arrangement for a wheelchair wheel, which has a running wheel that includes a hub and a hand rim. The sensor arrangement includes a running wheel fastening arrangement that can be fastened to the running wheel, a hand rim fastening arrangement that can be fastened to the hand rim and at least one sensor that detects a movement of the hand rim fastening arrangement relative to the running wheel fastening arrangement.

It is known to provide a sensor arrangement between a hand rim and a running wheel of a wheelchair wheel. The sensor arrangement makes it possible to detect when a user of the wheelchair moves the hand rim fastening arrangement, which is fastened to the hand rim relative to the running wheel fastening arrangement. If the user actuates the hand rim of the wheelchair wheel by exerting a tangential force on it in order to move forward or backward, this is registered by the sensor arrangement. The sensor arrangement sends a signal commensurate with the actuation to a drive unit of the wheelchair. The drive unit then assists the movement of the wheelchair wheel.

A sensor arrangement of this type is disclosed, for example, by DE 20 2009 009 929 U1. Upon actuation of the hand rim that is connected to the known sensor arrangement, a hand rim fastening arrangement is moved relative to a running wheel fastening arrangement. The hand rim fastening arrangement is connected to the running wheel fastening arrangement by means of at least two parallel bending plates. After the hand rim is released, the two bending plates return the hand rim fastening arrangement to a zero position relative to the running wheel fastening arrangement. Depending on how far the hand rim is moved from its zero position, an overshooting can occur during the restoring of the hand rim fastening arrangement. It is therefore difficult to reach an exact zero position of the hand rim fastening arrangement relative to the running wheel fastening arrangement.

For that matter, in very old, known sensor arrangement, i.e., with heavily fatigued bending plates, reaching a zero position after the release of the hand rim may not even be possible.

Finally, the known sensor arrangement is situated between the rim of the running wheel and the hand rim. Both the running wheel rim and the hand rim generally have irregularities and tolerances that significantly complicate the task of fastening the known sensor arrangement in position. The fastening options of the known sensor arrangement also are limited by the arrangement of the spokes of the running wheel.

DE 198 48 530 C1 discloses a control device configured for auxiliary drive units of self-propelled wheelchairs and is likewise equipped with a sensor arrangement. The sensor arrangement includes an armature that is supported so that it is able to pivot in a limited fashion, which is used to detect a movement of the hand rim relative to the running wheel. Two lateral arms of the armature are each acted on by a respective spring element that returns the armature to a zero position after the end of an exertion of a force on the hand rim. In this sensor arrangement, it is difficult to define and reliably reach the zero position of the sensor arrangement, depending on the design and fatigue of the spring elements. Finally, this known sensor arrangement is also situated between the rim of the running wheel and the hand rim. As such, irregularities and tolerances of the hand rim and the running wheel rim complicate the task of fastening the known sensor arrangement in position.

DE 20 2008 017 258 U1 also discloses a sensor arrangement in which an actuation of a hand rim moves a magnet in the vicinity of a Hall sensor. Two spring elements are arranged between the hand rim and the Hall sensor and move the hand rim back into a zero position after an actuation. Here, too, the problem arises that if the spring elements are fatigued, the zero position cannot be defined and reproducibly reached, after actuation of the hand rim.

Another example of a sensor arrangement between a hand rim and a running wheel is disclosed in EP 0 832 632 B1. The known sensor arrangement is integrated into the hub of the running wheel. An actuation of the hand rim, which has a significantly larger diameter than the hub, therefore results in only a small movement of the sensor arrangement integrated into the hub. The signal detected by the sensor arrangement is consequently relatively weak in relation to the movement of the hand rim. Two helical springs situated one inside the other restore the sensor arrangement after an actuation of the hand rim. A zero position of the sensor arrangement is reached in that the two end surfaces of a split inner sleeve in which the helical springs are situated rest against two stops of an outer sleeve in which the inner sleeve is in turn situated. The design of the known sensor arrangement with the outer sleeve, the split inner sleeve situated therein and the helical springs contained inside, however, can only be produced and assembled with difficulty.

SUMMARY OF THE INVENTION

The present invention provides a sensor arrangement provides a simply designed sensor arrangement for a wheelchair wheel that overcome shortcomings of the known arts.

The inventive sensor arrangement for a wheelchair wheel provides by means of which a zero position of the sensor arrangement can be reliably and reproducibly reached over the entire service life of the sensor arrangement.

In an embodiment, the sensor arrangement includes two restoring elements that are situated on a first fastening arrangement and rest against a second fastening arrangement with a prestressing force at least in the zero position. The two restoring elements rest against at least one stop of the first fastening arrangement in the zero position of the sensor arrangement. A first section of the first restoring element is situated so that it can be lifted away from the stop by a relative movement of the second fastening arrangement in a first direction relative to the first fastening arrangement. The first section of the first restoring element also can be moved in the first direction in opposition to the restoring force of the first restoring element. A second section of the second restoring element is situated so that it can be lifted away from the stop by a relative movement of the second fastening arrangement in a second direction relative to the first fastening arrangement. The second section of the second restoring element also can be moved in the second direction in opposition to the restoring force of the second restoring element.

The two restoring elements are mounted in the sensor arrangement. The return to the zero position is out simply by the arrangement of the two restoring elements that rest against the stop in the zero position. The sensor arrangement can therefore be inexpensively produced.

The sensor arrangement, as described above, is subjected to a prestressing force, i.e. is kept in the zero position by two restoring elements that are acted on with compression or tension. Even an increasing fatigue of the restoring elements merely causes them to rest less forcefully against the stop and whereby a reliably defined zero position is still reached. The sensor arrangement according to the invention makes it possible to detect an actuation of the hand rim in two directions, in particular an actuation for traveling in a forward and backward direction.

The restoring elements are preferably situated on the running wheel fastening arrangement, which also includes the stop. With a movement of the hand rim fastening arrangement relative to the running wheel fastening arrangement, the respective restoring element in this case is deflected by the hand rim fastening arrangement. Consequently, the running wheel fastening arrangement is preferably referred to as the first fastening arrangement and the hand rim fastening arrangement is preferably referred to as the second fastening arrangement.

Alternatively, instead of being fastened to the running wheel fastening arrangement, the restoring elements can be fastened to the hand rim fastening arrangement. The restoring elements rest in a prestressed fashion against a stop of the hand rim fastening arrangement, while a section of the restoring elements, when the hand rim fastening arrangement is moved relative to the running wheel fastening arrangement, is moved and lifted away from the stop by the running wheel fastening arrangement in opposition to the restoring force of the respective restoring element. In this case, the first fastening arrangement is the hand rim fastening arrangement and the second fastening arrangement is the running wheel fastening arrangement. Such an embodiment of the sensor arrangement constitutes an alternative embodiment of the invention.

For the sake of clarity, the following description of the invention is only presented for the case in which the first fastening arrangement is the running wheel fastening arrangement and the second fastening arrangement is the hand rim fastening arrangement. Alternatively, however, the invention also includes an arrangement in which the restoring elements are embodied on the hand rim fastening arrangement and the latter also includes the at least one stop.

Preferably, the sensor arrangement also may be situated radially on the hub of the running wheel. Since as a rule, the hub is embodied as a rotating part, its tolerances do not have to be compensated for. Fastening the sensor arrangement is therefore a simple operation. In this case, the sensor arrangement has a curved region on its side oriented toward the hub, on which side the sensor arrangement is fastened to the hub by means of fasteners such as screws. At the same time, the sensor arrangement situated radially on the hub is highly sensitive since it is possible to detect the movement of the hand rim not in the region of the hub, but spaced radially apart from the hub in the region of the hand rim. Even a slight movement of the hand rim therefore results in a strong signal.

Instead of a shared stop for the two restoring elements, in a zero position of the sensor arrangement, the first restoring element can rest against a first stop and the second restoring element can rest against a second stop of the running wheel fastening arrangement. In this context, a stop is understood to be the stop surface against which the respective restoring element rests in the zero position of the sensor arrangement. The two stops can each be embodied on separate respective elements between which additional parts of the sensor arrangement are provided. The two stops also can be embodied on a single element. This achieves a particularly stable embodiment of the stops.

The restoring elements preferably have the same spring constant. An actuation of the hand rim for moving the wheelchair forward or backward thus exerts the same restoring force on the hand rim fastening arrangement.

The restoring elements are preferably still arranged symmetrically relative to the hand rim fastening arrangement. It is thus possible to keep the hand rim fastening arrangement in the zero position, which in the middle between two symmetrically arranged restoring elements.

In an embodiment, the distance between the stops corresponds to a distance between the side surfaces of an actuating means of the hand rim fastening arrangement against which the restoring elements rest in the zero position of the sensor arrangement. The sections of the restoring elements that simultaneously rest against the side surfaces of the actuating means and the stops of the running wheel fastening arrangement in the zero position of the sensor arrangement can therefore be embodied as flat.

The actuating means also is preferably configured so that its side surfaces against which the restoring elements rest in the zero position of the sensor arrangement are flush with the stops in the zero position of the sensor arrangement. A first side surface of the actuating means is thus flush with the first stop of the running wheel fastening arrangement and a second side surface is flush with the second stop of the running wheel fastening arrangement. This achieves a particularly precise, play-free arrangement of the actuating means relative to the restoring means.

The actuating means is arranged at least partially above the stops, permitting a space-saving design of the sensor arrangement.

The hand rim fastening arrangement has an articulating element that is connected to the running wheel fastening arrangement in pivoting fashion. The pivotability of the articulating element achieves a smooth actuation of the sensor arrangement. The articulating element is essentially rod-shaped and is supported on the running wheel fastening arrangement in pivoting fashion by means of a pin.

In an embodiment, the articulating element is in the form of the actuating means. This makes it possible to reduce the number of parts used and permits the sensor arrangement to be manufactured in a particularly simple and inexpensive way.

In addition, at least one spring element can is provided such that the running wheel fastening arrangement is connected to the hand rim fastening arrangement via the spring element. In this case, the spring element is more stable and rigid than the at least one restoring element. The spring element thus contributes the main part of the restoring force of the sensor arrangement in an actuation of the hand rim. The spring element may be embodied as a helical spring, a rubber cushion, or the like.

The spring element and/or the articulating element is preferably situated symmetrically between two restoring elements. The user then feels the same restoring force when actuating the hand rim in a forward direction and in a reverse direction.

A particularly stable embodiment of the sensor arrangement is achieved when the spring element and/or articulating element is connected to the running wheel fastening arrangement and/or hand rim fastening arrangement with positive engagement and/or nonpositive, frictional engagement.

At least one restoring element and/or the spring element is embodied in the form of at least one bending plate. Bending plates can be easily positioned in the sensor arrangement. In addition, the restoring force of the sensor arrangement is set so that a larger or smaller number of bending plates can be used for embodying the at least one restoring element and/or spring element.

The running wheel fastening arrangement includes a housing in which at least one restoring element, at least one spring element, and/or an articulating element are situated. The housing provides weatherproof protection for sensitive parts of the sensor arrangement. Preferably, the housing is composed of plastic. Alternatively, however, instead of the running wheel fastening arrangement being equipped with a housing, the hand rim fastening arrangement can be equipped with one.

The housing should be torsionally rigid in order to absorb forces that are inevitably produced when the user actuates the hand rim at a single point. Particularly powerful forces are produced when the user "grabs" the hand rim or in the event of an impact at a particular point on hand rim.

The housing is provided with an end stop for the movement of the hand rim fastening arrangement. Preferably, the inner wall of the housing is embodied as an end stop for the movement of the hand rim fastening arrangement. This avoids a plastic deformation of the sensor arrangement by a very powerful actuation of the hand rim by the user.

The housing preferably has a curved region on its underside. This permits the housing to be optimally positioned on the hub of the running wheel. The curved region of the housing includes at least one bore to permit screws, which are provided to fasten the housing to the hub, to pass through the housing.

The hand rim fastening arrangement lies at least partially against a side of the housing oriented toward the hand rim. As a result, axial impacts on the hand rim are absorbed by the housing.

For example, the sensor can be embodied in the form of a pressure sensor or force sensor. A particularly precise measurement of the actuation of the hand rim is achieved where the sensor is a Hall sensor and at least one magnet is provided for contactless stimulation of the Hall sensor. In this case, the Hall sensor is preferably situated on the running wheel fastening arrangement and at least one magnet is situated on the hand rim fastening arrangement, preferably on the articulating element. Alternatively, however, the arrangement can be reversed. In this case, the Hall sensor outputs a larger or smaller signal depending on the magnitude of the tangential and/or lateral force introduced into the hand rim.

For production reasons, the hand rims used in wheelchair wheels are produced in a relatively imprecise fashion leading to dimensional accuracy. Consequently, the hand rims used are generally encumbered with high production tolerances. The sensor arrangement should, however, be mounted between the hand rim and the running wheel in the most tension-free manner possible In order to compensate for production tolerances, the sensor arrangement is equipped with a compensating arrangement. The compensating arrangement is preferably provided for connecting the hand rim fastening arrangement to the hand rim. The compensating arrangement is connected to the hand rim fastening arrangement and/or the hand rim with positive engagement and/or by material adhesion. Alternatively or in addition to this, the compensating arrangement is provided on the running wheel fastening arrangement. The compensating arrangement is adjustable in three dimensions within certain limits and is thus able to compensate for production tolerances in all directions. The compensating arrangement thus permits a "floating" or "labile" support of the hand rim on the sensor arrangement.

The compensating arrangement preferably has a compensating sleeve. The compensating sleeve includes a through opening arranged along its longitudinal axis and has a constant inner diameter. When the sensor arrangement is fastened to the running wheel, the longitudinal axis is preferably oriented parallel to the axle of the running wheel.

The through opening is embodied as rotationally symmetrical or eccentric relative to the outer surface of the compensating sleeve. For example, the through opening can be offset by a few tenths of a millimeter relative to the outer surface of the compensating sleeve so that the compensating sleeve compensates for the tolerances of the hand rim. The invention therefore includes a set composed of a sensor arrangement and a plurality of compensating sleeves whose through openings are embodied with different eccentric offsets relative to the outer surface of the compensating sleeves. In this case, when the sensor arrangement is mounted on the running wheel, the correspondingly fitting compensating sleeve is selected in accordance with the tolerance of the hand rim.

The compensating sleeve preferably has a convex or spheroidal outer surface. The convex outer surface preferably rests partially against the inner surface of an opening of the hand rim fastening arrangement. Such arrangement makes it possible to compensate for production tolerances of the hand rim in a plane perpendicular to the longitudinal direction of the compensating sleeve.

The compensating sleeve also is preferably arranged to move in its longitudinal direction in the hand rim fastening arrangement, i.e. in the axial direction of the running wheel, in order to be able to compensate for tolerances of the hand rim. The mobility in this case preferably amounts to a few tenths of a millimeter.

Depending on the tolerances of the hand rim, compensating sleeves can once again be used, which have differently embodied outer surfaces in order to be able to optimally compensate for the tolerances of the hand rim.

The outer surface of the compensating sleeve is provided with a corresponding shape to prevent it from subsequently rotating. For example, one or more grooves or teeth in the outer surface are provided for this purpose.

In order to exert stress on the at least one restoring element only within its elastic range, the running wheel fastening arrangement is provided with at least one hand rim fastening arrangement stop for limiting the movement of the hand rim fastening arrangement relative to the running wheel fastening arrangement. Alternatively or in addition to this, the hand rim fastening arrangement can be provided with at least one running wheel fastening arrangement stop for limiting the movement of the running wheel fastening arrangement relative to the hand rim fastening arrangement.

Two hand rim fastening arrangement stops are preferably constituted by an opening that is provided in the running wheel fastening arrangement and is embodied in the form of an oblong hole. The hand rim fastening arrangement can pass through the oblong hole, which limits the movement of the hand rim fastening arrangement relative to the running wheel fastening arrangement due to the dimensions of the oblong hole.

The invention also relates to a wheelchair wheel having a running wheel and a hand rim, with the running wheel and hand rim being connected by means of the at least one sensor arrangement.

In order to control a drive unit of the wheelchair wheel, it is only necessary to provide one sensor arrangement on the wheelchair wheel. However, the hand rim also should be connected to the running wheel at other points. These connections should have an appearance similar to that of the sensor arrangement. Accordingly, the running wheel and the hand rim are connected by means of one or more connecting arrangements. The connecting arrangements corresponds to a sensor arrangement without the sensor.

The connecting arrangements and the sensor arrangement are therefore essentially identical. The only difference is that the connecting arrangements have no sensors.

The control unit includes an evaluation unit that is set up to detect both a force exerted on the hand rim and the speed of the actuation of the hand rim. This enables optimal activation of the drive unit to assist the user.

The invention also includes a wheelchair equipped with a wheelchair wheel according to the invention.

Further details will become apparent from the exemplary embodiment depicted in the following. The invention is explained in greater detail in the following with reference to an example.

BRIEF DESCRIPTION OF THE DRAWING FIGURES

Figure 1B:
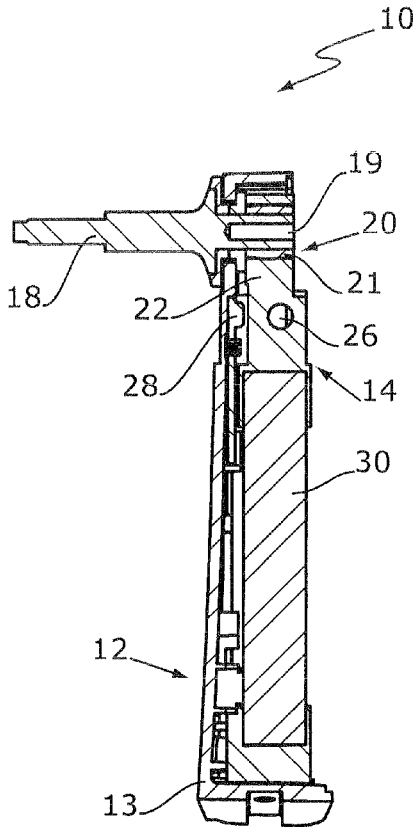

Further features and advantages of the invention will become apparent from the description of embodiments that follows, with reference to the attached figures, wherein:

FIG. 1*a* is a top view of the front side of a sensor arrangement according to the invention, without the housing cover;

FIG. 1*b* is a sectional depiction along the line B-B the sensor arrangement shown in FIG. 1*a;*

Figure 1C:
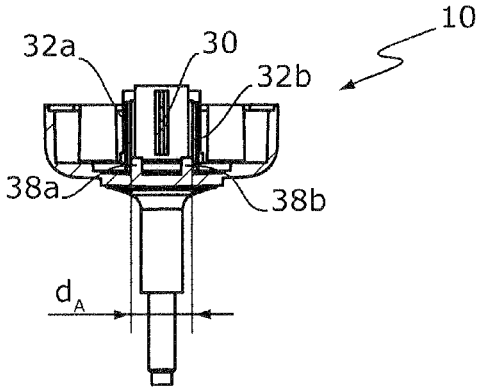

FIG. 1*c* is a sectional depiction along the line C-C of the sensor arrangement shown in FIG. 1*a;*

Figure 2A:
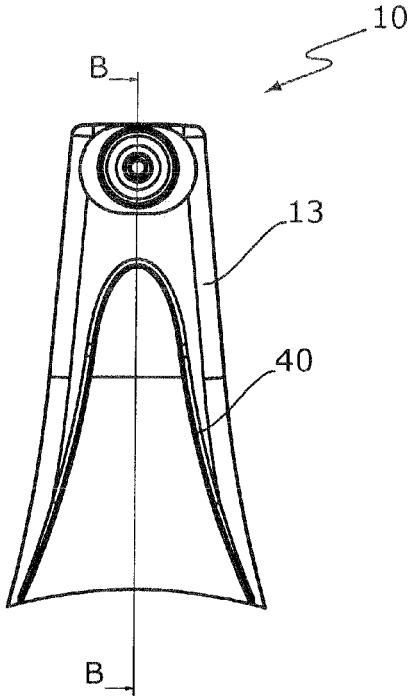
Figure 2B:
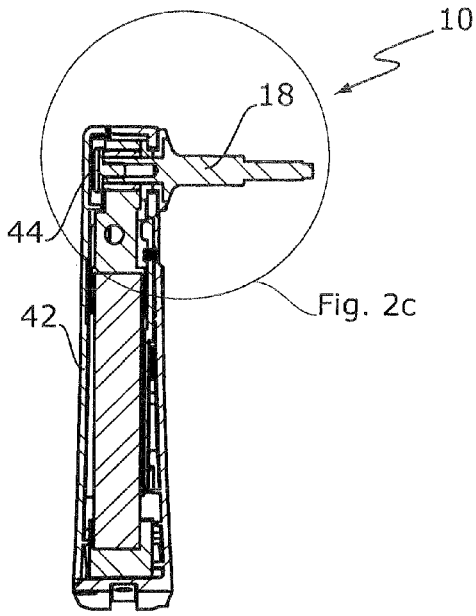

FIG. 2*a* is a top view of the rear side of the sensor arrangement shown in FIG. 1, with the housing cover;

FIG. 2*b* is a sectional depiction along the line B-B of the sensor arrangement shown in FIG. 2*a;*

Figure 2C:
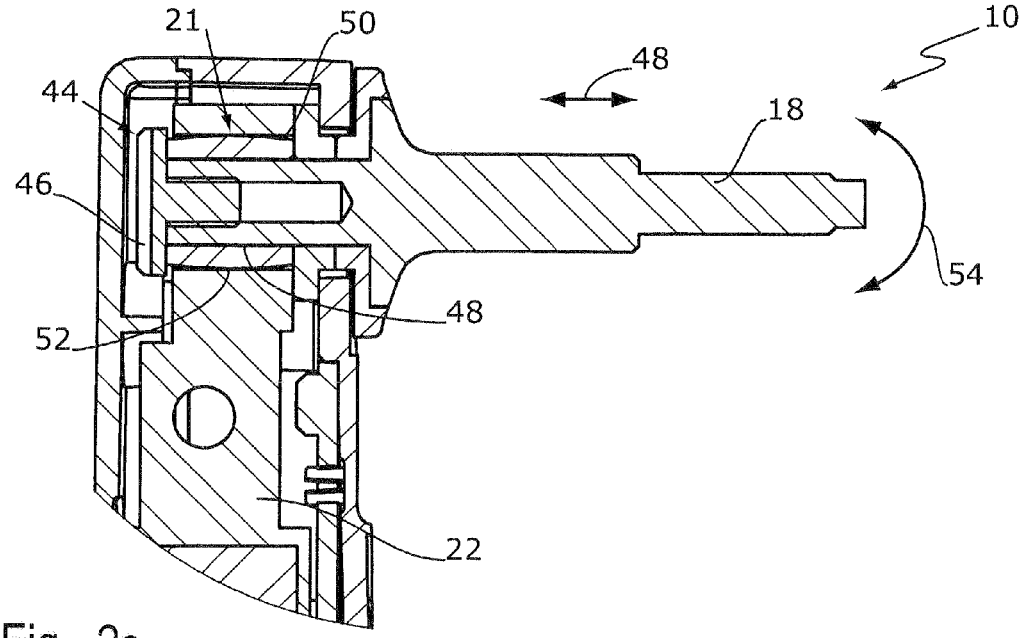

FIG. 2*c* is an enlarged depiction of the circled region of the sensor arrangement shown in FIG. 2*b;*

Figure 3A:
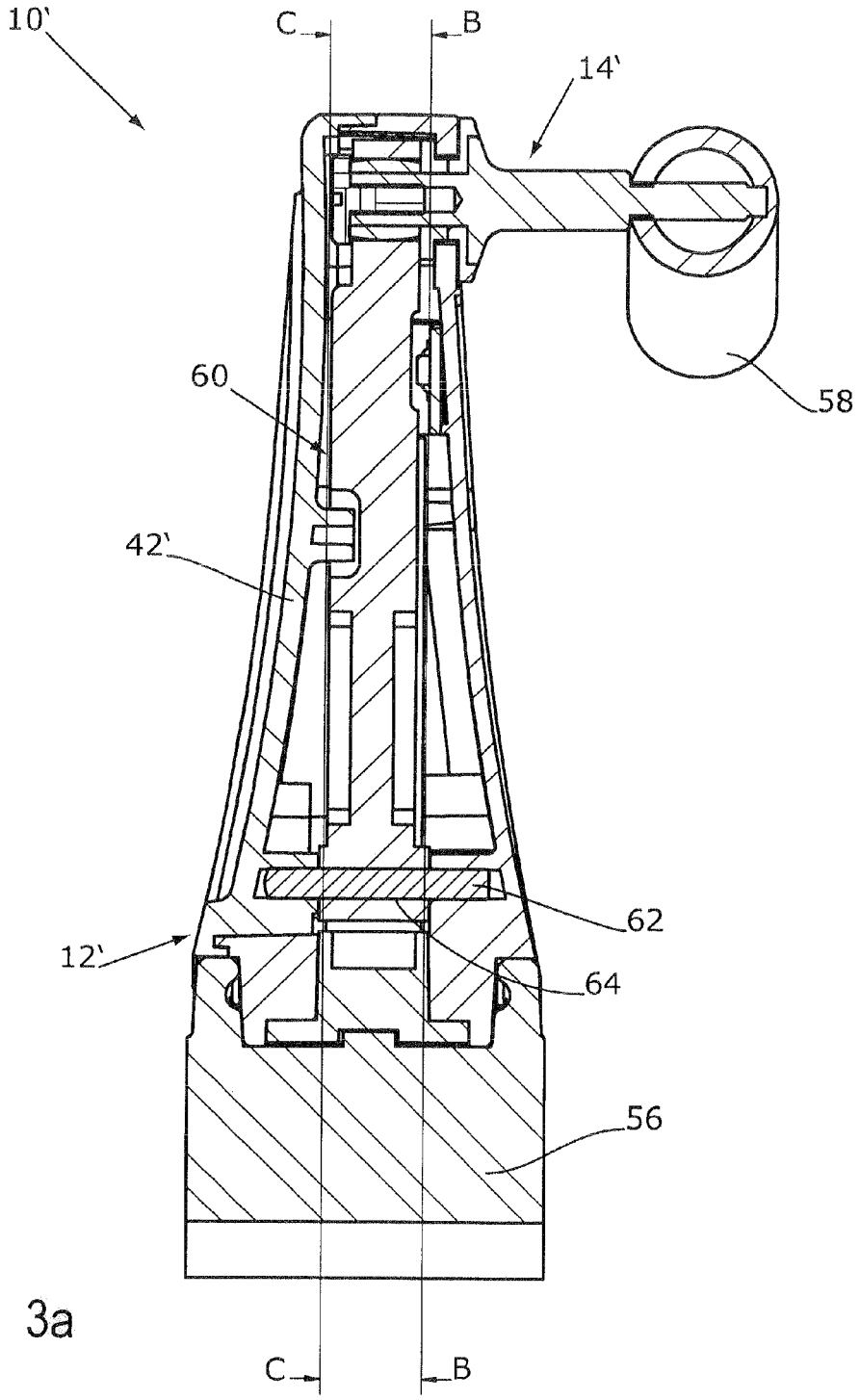
Figure 3B:
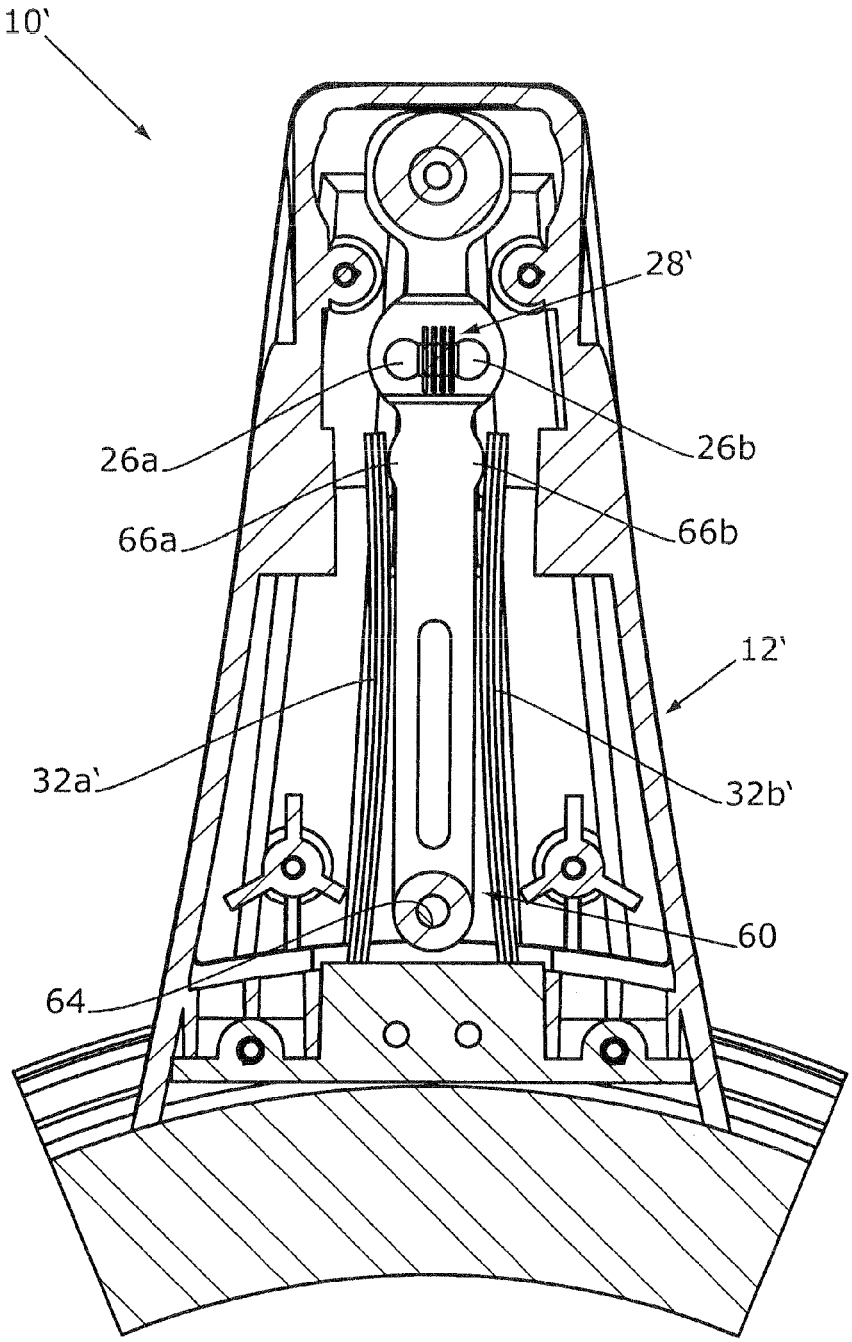
Figure 3C:
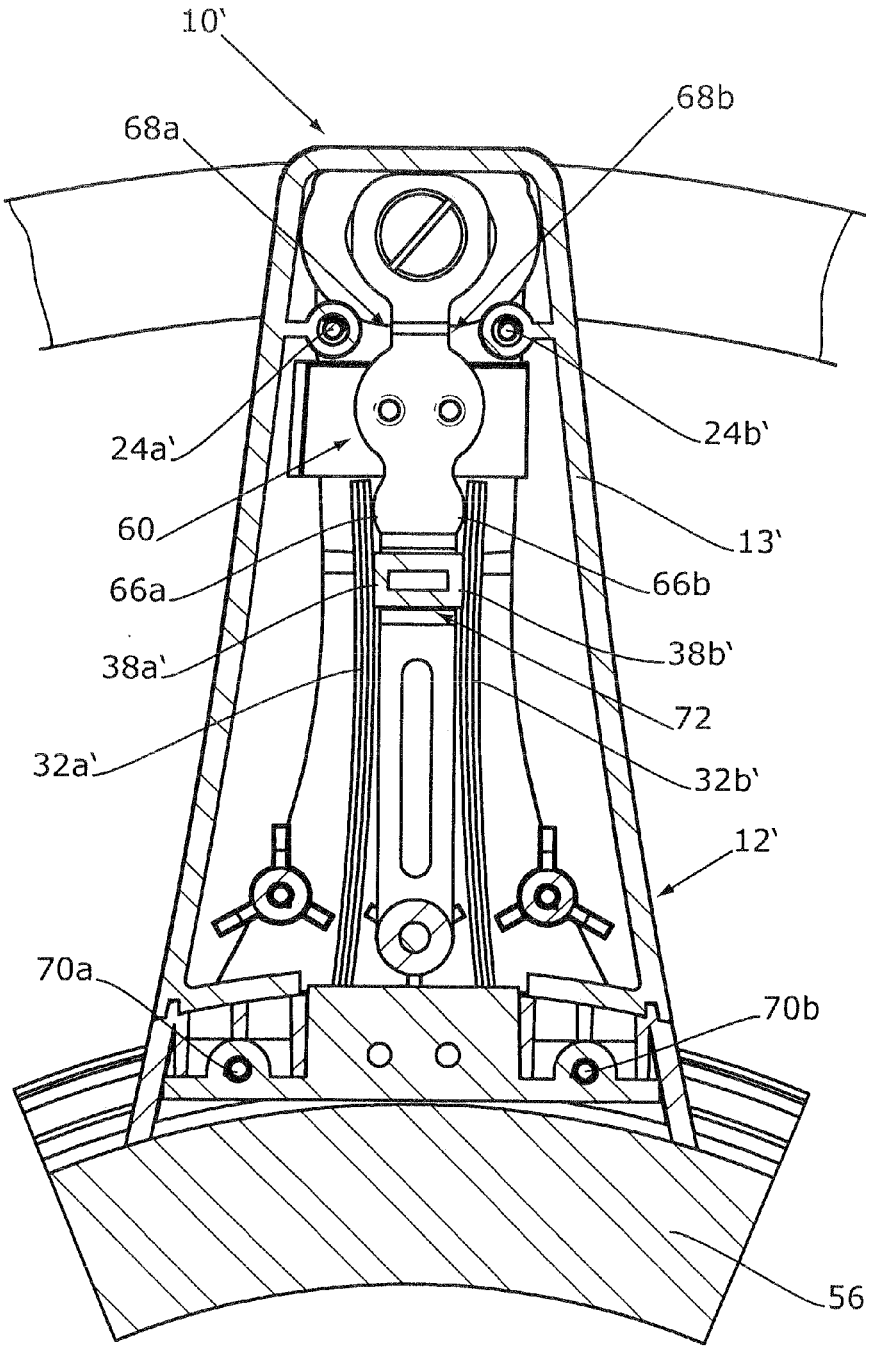

FIG. 3*a* is a sectional depiction of a another sensor arrangement according to the invention;

FIG. 3*b* is a sectional depiction along the line B-B of the sensor arrangement shown in FIG. 3*a*; and FIG. 3*c* is a sectional depiction along the line C-C of the sensor arrangement shown in FIG. 3*a.*

DETAILED DESCRIPTION OF THE PREFERRED EMBODIMENTS

The following is a detailed description of example embodiments of the invention depicted in the accompanying drawings. The example embodiments are presented in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives falling within the spirit and scope of the present invention, as defined by the appended claims.

The sensor arrangement is explained initially in conjunction with an overview of FIGS. 1*a-c.*

FIG. 1*a* is a top view of a first sensor arrangement 10. The sensor arrangement 10 has a first fastening arrangement 12 and a second fastening arrangement 14. The first fastening arrangement 12 is a running wheel fastening arrangement 12. The second fastening arrangement 14 is a hand rim fastening arrangement 14. For the sake of clarity and comprehensibility, the first fastening arrangement 12 will be referred to below as the running wheel fastening arrangement 12 and the second fastening arrangement 14 will be referred to as the hand rim fastening arrangement 14.

The running wheel fastening arrangement 12 includes a housing 13 composed of polycarbonate. The housing 13 of the running wheel fastening arrangement 12 has a housing cover. This housing cover is not shown in FIG. 1*a* in order to provide a view of the interior of the housing 13. The housing cover can be fastened by means of screws, not shown, to screw bosses 16*a-d* that are situated on the housing 13 and provided with bores.

At its bottom 17, the running wheel fastening arrangement 12 is fastened to the hub of a running wheel (not shown). The hand rim fastening arrangement 14 is fastened to a hand rim (not shown). A connecting journal 18 that is particularly visible in FIG. 1*b* is provided for fastening the hand rim fastening arrangement 14 to the hand rim. The connecting journal 18 has a bore 19 into which a screw, not shown, is screwed. The connecting journal 18 is connected to an actuating means 22 of the hand rim fastening arrangement 14 via a compensating arrangement 20 that has a compensating sleeve 21. In the exemplary embodiment shown, the longitudinal direction of the compensating sleeve 21 is identical to the longitudinal direction of the bore 19 and oriented parallel to the axle of the running wheel when a sensor arrangement 10 is mounted on the hub.

As is shown in FIG. 1*a*, the connecting journal 18 is guided in an oblong hole 23. The end limits of the oblong hole 23 constitute two hand rim fastening arrangement stops 24*a*, 24*b*. When the hand rim is actuated, which moves the connecting journal 18, the maximum distance that the connecting journal 18 can be moved is the distance to the hand rim fastening arrangement stops 24*a*, 24*b*. Then the connecting journal 18 comes into contact with the respective hand rim fastening arrangement stop 24*a*, 24*b*. The movement of the connecting journal 18 also produces a movement of the actuating means 22. Alternatively or in addition to the action of the hand rim fastening arrangement stops 24*a*, 24*b*, therefore, a part of the actuating means 22 can come into contact with an inside of the housing 13. This contact limits the maximum movement of the hand rim fastening arrangement in the housing 13.

The actuating means 22 is provided with a magnet 26, which, as is shown in FIG. 1*b*, is moved when the actuating means 22 is moved past a sensor 28 in the form of a Hall sensor. The sensor 28 is situated on a rear wall of the housing 13 of the running wheel fastening arrangement 12. The sensor 28 is therefore able to detect a movement of the actuating means 22 relative to the running wheel fastening arrangement 12.

A restoring force acting on the actuating means 22 is essentially determined by the elasticity of a spring element 30. The spring element 30 is connected at both ends to the actuating means 22 and the running wheel fastening arrangement 12, respectively, with positive engagement and/or nonpositive, frictional engagement.

The spring element 30 therefore guides the actuating means 22 relative to the running wheel fastening arrangement 12. The spring element 30 takes the form of a plurality of parallel springs. The more elastic the spring element 30 is, the farther the actuating means 22 is deflected relative to the running wheel fastening arrangement 12 with an actuation of the hand rim of equal force.

As is shown in FIG. 1*a*, the spring element 30 is symmetrically situated in the middle between two restoring elements 32*a*, 32*b*. The restoring elements 32*a*, 32*b* take the form of bending plates which are connected at their bottom ends 34*a*, 34*b* to the running wheel fastening arrangement 12 with positive engagement and/or with nonpositive, frictional engagement.

The restoring elements 32*a*, 32*b* make it possible to achieve a reliably reproducible zero position of the actuating means 22. For this purpose, sections 36*a*, 36*b* of the restoring elements 32*a*, 32*b* rest with prestressing force against the actuating means 22. In addition, the restoring elements 32*a*, 32*b* rest with prestressing force against stops 38*a*, 38*b* of the running wheel fastening arrangement 12. The stops 38*a*, 38*b* are shown in FIG. 1*c*.

The distance $d_A$ between the outer surfaces of the stops 38*a*, 38*b* corresponds to the distance $d_S$, shown in FIG. 1*a*, between the surfaces of the actuating means 22 against which the sections 36*a*, 36*b* of the restoring elements 32*a*, 32*b* rest. As shown in FIG. 1*c*, the actuating means 22, is situated above the stops 38*a*, 38*b*. The sections 36*a*, 36*b* of the restoring elements 32*a*, 32*b* therefore rest without play against the stops 38*a*, 38*b* and the actuating means 22 simultaneously.

The position of the sensor arrangement 10 shown in FIG. 1*a* corresponds to a zero position. If the hand rim is actuated and the hand rim fastening arrangement 14 is moved relative to the running wheel fastening arrangement 12 (for example in a direction of arrow 39), the actuating means 22 lifts the first restoring element 32*a* away from its first stop 38*a* and deflects it in the direction of the arrow 39. The second restoring element 32*b* remains resting against the second stop 38*b* and is thus decoupled from the actuating means 22. If the user stops actuating the hand rim, the first restoring element 32*a* and the spring element 30 move the actuating means 22 back into its zero position. By means of its prestressing force that is likewise present in the zero position, the first restoring element 32*a* ensures that the actuating means 22 is always moved back to the zero position, i.e. is moved until the first restoring element 32*a* comes to rest against the first stop 38*a*.

The spring element 30 is not required to ensure the zero position of the sensor arrangement 10. Instead of the spring element 30, the hand rim fastening arrangement 14 that is guided in the oblong hole 23 can, for example, be guided back into the zero position only by means of the restoring elements 32*a*, 32*b*. In this case, the restoring elements 32*a*, 32*b* are preferably less elastic, for example, in a form of a plurality of parallel leaf springs. It is also possible, however, that the restoring elements 32*a*. 32*b* may be formed as helical springs or the like.

Even where one of the restoring elements 32*a*, 32*b* has a greater prestressing force than the other respective restoring element 32*a*, 32*b*, will not influence the zero position of the actuating means 22 since the restoring elements 32*a*, 32*b* cannot (as demonstrated by FIG. 1*c*), be moved past the stops 38*a*, 38*b*. One of the restoring elements 32*a*, 32*b* may be significantly more elastic than the other restoring element 32*a*, 32*b* still without shifting the zero position of the actuating means 22.

FIG. 2*a* is a top view of the rear side of the sensor arrangement 10. In order to reduce weight, the housing 13 is composed of plastic. At the same time, the housing 13 has a high strength. The housing 13 of the sensor arrangement 10 also has a reinforcing profile 40. As a result, the housing 13 is particularly torsionally rigid and stable.

FIG. 2*b* is a side view of the sensor arrangement 10 from FIG. 2*a*. In FIG. 2*b*, a housing cover 42 of the sensor arrangement 10 is visible. The connecting journal 18 is axially secured by a screw 44.

FIG. 2*c* is an enlarged depiction of the circled region in FIG. 2*b*. It is clear from this depiction that a screw head 46 of the screw 44 does not rest against the actuating means 22. A distance of a few tenths of a millimeter remains between the screw head 46 and the actuating means 22. The connecting journal 18 is therefore able to move in the direction of the double arrow 48, i.e., in the axial direction of a running wheel, not shown, which is connected to the sensor arrangement. Tolerances of a hand rim connected to the connecting journal 18 can thus be compensated for in the axial direction.

Other tolerances of the hand rim are compensated for by means of the compensating sleeve 21. The compensating sleeve 21 is at least rotationally symmetrical to its longitudinal axis and on its outside and is equipped with at least one groove or pin as a rotation-prevention means (not shown). The compensating sleeve 21 has a through opening 48 with a constant inner diameter. In the region of this through opening 48, the connecting journal 18 rests against the inner region of the through opening 48. An outer surface 50 of the compensating sleeve 21, however, is convex, i.e. with a curvature. The compensating sleeve therefore rests against the actuating means 22 only in an annular region 52. Due to the distance between the screw head 46 and the actuating means 22 and due to the convex embodiment of the outer surface 50 of the compensating sleeve 21, the connecting journal 18 is able to move in a limited fashion in the direction of a double arrow 54. It is thus possible to compensate for tolerances of the hand rim when mounting the sensor arrangement 10.

Another embodiment of a sensor arrangement 10' according to the invention is shown in FIG. 3*a*. The sensor arrangement 10' has a running wheel fastening arrangement 12', which is fastened to a hub 56 of a running wheel, and a hand rim fastening arrangement 14', which is fastened to a hand rim 58. The running wheel fastening arrangement 12' has a housing cover 42'. The hub 56 and the hand rim 58 are partially shown.

By contrast with the sensor arrangement 10 shown in FIGS. 1 and 2, the hand rim fastening arrangement 14 has an articulating element 60 that is connected to the running wheel fastening arrangement 12' in pivoting fashion. The articulating element 60 is one piece and includes a through opening 62 into which a pin 64 is inserted. The articulating element 60 is thus able to pivot around the axis of the through opening 62.

As is clear from FIG. 3*b*, the articulating element 60 is situated centrally between two restoring elements 32*a'*, 32*b'*, each embodied as a plurality of leaf springs. In this case, the number of leaf springs determines the restoring force of the sensor arrangement 10' that the user must overcome when actuating the hand rim, which is not visible in FIG. 3*b*. When the hand rim is actuated, the articulating element 60 is not bent, but rather pivoted around the axis of the through opening 64. The articulating element 60 is thus embodied in the form of an actuating means and has two articulating element protrusions 66*a*, 66*b* against which the restoring elements 32*a'*, 32*b'* rest in the non-actuated state of the sensor arrangement 10'.

The sensor 28' situated on the running wheel fastening arrangement 12' embodies a Hall sensor and is depicted in a sectional view. The deflection of the articulating element 60 is detected by the change in the magnetic field in the region of the sensor 28', which results from the movement of two magnets 26*a*, 26*b* that are situated in the articulating element 60.

As is clear from FIG. 3*c*, the running wheel fastening arrangement 12' has a housing 13' on which two fastening arrangement stops 24*a*', 24*b*' embody protrusions. With a maximum actuation of the hand rim 58, a first articulating element recess 68*a* or a second articulating element recess 68*b* of the articulating element 60 comes to rest against the respective fastening arrangement stop 24*a*', 24*b*'. The articulating element recesses 68*a*, 68*b* are symmetrical relative to the longitudinal axis of the articulating element 60 and thus constitute a neck region of the articulating element 60. When a maximum deflection of the articulating element 60 occurs, the respective fastening arrangement stop 24*a*', 24*b*' comes into contact with the respective articulating element recess 68*a*, 68*b* with at least partially positive engagement. The remainder of the force that the user exerts on the hand rim 58 is then transmitted to the hub 56 completely, i.e. without causing components of the sensor arrangement 10' to bend.

The sensor arrangement 10' is fastened to the hub 56 by means of screws, not shown, which are inserted through the through openings 70*a*, 70*b* in the running wheel fastening arrangement 12'.

In the zero position, i.e. in the non-actuated state of the sensor arrangement 10', the restoring elements 32*a*', 32*b*' rest against stops 38*a*', 38*b*' of the running wheel fastening arrangement 12'. In this case, the stops 38*a*', 38*b*' are provided in the form of the side surfaces of a rectangular projection 72, which is adhered to a housing cover 42' that belongs to the running wheel fastening arrangement 12' and is visible in FIG. 3*a*. The distance between the stops 38*a*', 38*b*' corresponds to the distance between the pivoting element protrusions 66*a*, 66*b*, which are oriented toward the restoring elements 32*a*', 32*b*' and belong to the pivoting element 60 embodied in the form of an actuating means.

In summary, the invention relates to a sensor arrangement for a wheelchair wheel, which has a running wheel that includes a hub and a hand rim. The sensor arrangement includes a running wheel fastening arrangement that is fastened to the running wheel, a hand rim fastening arrangement that is fastened to the hand rim and at least one sensor that detects a movement of the hand rim fastening arrangement relative to the running wheel fastening arrangement. Two restoring elements are situated on the running wheel fastening arrangement and rest against the hand rim fastening arrangement with a prestressing force at least in the zero position. Both of the restoring elements rest against at least one stop of the running wheel fastening arrangement in the zero position of the sensor arrangement.

A first section of the first restoring element is situated so that it can be lifted away from the stop by a movement of the hand rim fastening arrangement in a first direction relative to the running wheel fastening arrangement and can be moved in the first direction in opposition to the restoring force of the first restoring element. A second section of the second restoring element is situated so that it can be lifted away from the stop by a movement of the hand rim fastening arrangement in a second direction relative to the running wheel fastening arrangement and can be moved in the second direction in opposition to the restoring force of the second restoring element.

As will be evident to persons skilled in the art, the foregoing detailed description and figures are presented as examples of the invention, and that variations are contemplated that do not depart from the fair scope of the teachings and descriptions set forth in this disclosure. The foregoing is not intended to limit what has been invented, except to the extent that the following claims so limit that.

What is claimed is:

1. A sensor arrangement (10, 10') for a wheelchair wheel, which has a running wheel that includes a hub (56) and a hand rim (58), comprising:

a first fastening arrangement (12, 12') fastened to the running wheel;

a second fastening arrangement (14, 14') fastened to the hand rim (58); and at least one sensor (28, 28') for detecting a movement of the hand rim fastening arrangement (14, 14') relative to the running wheel fastening arrangement (12, 12'), wherein two restoring elements (32*a*, 32*a*', 32*b*, 32*b*') are provided, which are situated on the first fastening arrangement (12, 12') and rest against the second fastening arrangement (14, 14') with a prestressing force at least in the zero position, and both restoring elements (32*a*, 32*a*', 32*b*, 32*b*') rest against at least one stop (38*a*, 38*a*', 38*b*, 38*b*') of the first fastening arrangement (12, 12') in the zero position of the sensor arrangement (10, 10'), wherein a first section (36*a*) of the first restoring element (32*a*, 32*a*') is configured to be lifted away from the stop (38*a*, 38*a*', 38*b*, 38*b*') by a first relative movement of the first and second fastening arrangements (12, 12', 14, 14') and to be moved in opposition to the restoring force of the first restoring element (32*a*, 32*a*'), and wherein a second section (36*b*) of the second restoring element (32*b*, 32*b*') is configured to be lifted away from the stop (38*a*, 38*a*, 38*b*, 38*b*') by a second relative movement of the first and second fastening arrangements (12, 12', 14, 14') and to be moved in opposition to the restoring force of the second restoring element (32*b*, 32*b*').

2. The sensor arrangement as recited in claim 1, wherein in the zero position of the sensor arrangement (10, 10'), the first restoring element (32*a*, 32*a*') rests against a first stop (38*a*, 38*a*') of the first fastening arrangement (12, 12') and the second restoring element (32*b*, 32*b*') rests against a second stop (38*b*, 38*b*') of the first fastening arrangement (12, 12').

3. The sensor arrangement as recited in claim 2, wherein the distance ($d_A$) between the stops (38*a*, 38*a*', 38*b*, 38*b*') corresponds to a distance ($d_S$) between the side surfaces of an actuating means (22) of the second fastening arrangement (14, 14') against which the restoring elements (32*a*, 32*a*', 32*b*, 32*b*') rest in the zero position.

4. The sensor arrangement as recited in claim 3, wherein the actuating means (22) is situated so that the side surfaces against which the restoring elements (32*a*, 32*a*', 32*b*, 32*b*') rest in the zero position are flush with the stops (38*a*, 38*b*).

5. The sensor arrangement as recited in claim 1, wherein the second fastening arrangement has at least one articulating element (60) that is mounted on the first fastening arrangement in pivoting fashion.

6. The sensor arrangement as recited in claim 1, wherein the first fastening arrangement (12, 12') has a housing (13, 13') in which at least one restoring element (32*a*, 32*a*', 32*b*, 32*b*') or at least one articulating element (60) or both is situated.

7. The sensor arrangement as recited in claim 1, wherein the sensor (28, 28') is a Hall sensor and at least one magnet (26, 26*a*, 26*b*) is provided for contactless stimulation of the Hall sensor.

8. The sensor arrangement as recited in claim 1, wherein the sensor arrangement (10, 10') has a compensating arrangement (20) to compensate for tolerances of the hand rim (58).

9. The sensor arrangement as recited in claim 8, wherein the compensating arrangement (20) has a compensating sleeve (21).

10. The sensor arrangement as recited in claim 9, wherein the compensating sleeve (21) has a convex outer surface (52).

11. The sensor arrangement as recited in claim 10, wherein the outer surface of the compensating sleeve (21) is equipped with a rotation-prevention means.

12. The sensor arrangement as recited in claim 1, wherein on the first fastening arrangement (12, 12'), at least one fastening arrangement stop (24*a*, 24*a*', 24*b*, 24*b*') is provided to limit the movement of the second fastening arrangement (14, 14') relative to the first fastening arrangement (12, 12').

13. The sensor arrangement as recited in claim 12, wherein in the first fastening arrangement (12), an opening in the form of an oblong hole (23) provides the at least one fastening arrangement stop (24*a*, 24*b*).

14. A wheelchair wheel having a running wheel and a hand rim (58), wherein the running wheel and hand rim (58) are connected by means of at least one sensor arrangement (10, 10') as recited in claim 1.

15. The wheelchair wheel as recited in claim 14, wherein the running wheel and the hand rim (58) are connected by one or more connecting arrangements and wherein at least one connecting arrangement corresponds to a sensor arrangement (10, 10') without a sensor (28, 28').

16. A wheelchair comprising a wheelchair wheel as recited in claim 14.

* * * * *